United States Patent [19]

Coyle et al.

[11] 4,206,328

[45] Jun. 3, 1980

[54] PUSHBUTTON ASSEMBLY

[75] Inventors: Forrest E. Coyle; Denis E. Bedel, both of Pittsburgh, Pa.

[73] Assignee: Westinghouse Electric Corp., Pittsburgh, Pa.

[21] Appl. No.: 941,719

[22] Filed: Sep. 12, 1978

[51] Int. Cl.[2] ..... H01H 27/00
[52] U.S. Cl. ..... 200/44; 200/42 R
[58] Field of Search ..... 200/44, 42 R, 321, 328

[56] References Cited

U.S. PATENT DOCUMENTS

| | | | |
|---|---|---|---|
| 1,544,467 | 6/1925 | McDonald | 200/44 |
| 2,343,412 | 3/1944 | Immel | 200/44 |

*Primary Examiner*—Steven M. Pollard
*Attorney, Agent, or Firm*—D. R. Lackey

[57] ABSTRACT

A pushbutton assembly having a key operable actuating plunger. The key operable actuating plunger includes a locking tab insertable in the space between a stop member which secures the actuating plunger in the housing, and a wall portion of a slot in the housing which receives the stop member.

7 Claims, 19 Drawing Figures

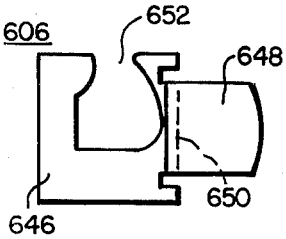
FIG.12.
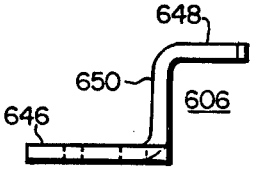
FIG.11.
FIG.14.
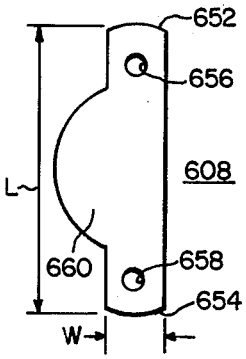
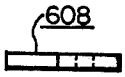
FIG.13.
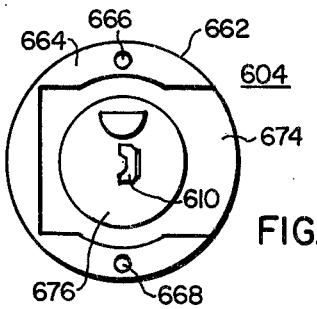
FIG.15.
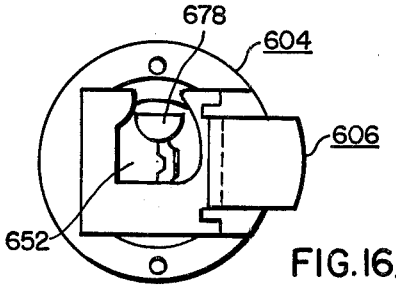
FIG.16.
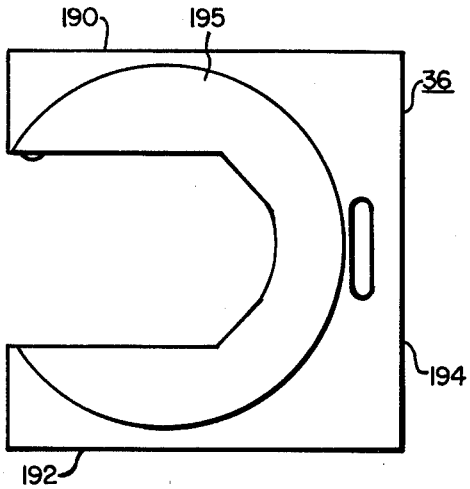
FIG.9.
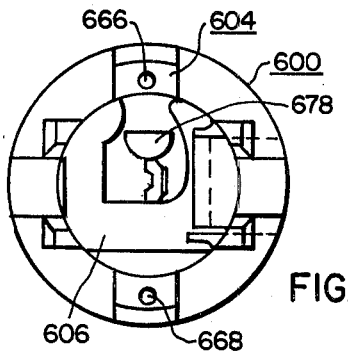
FIG.17.
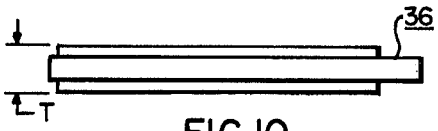
FIG.10.
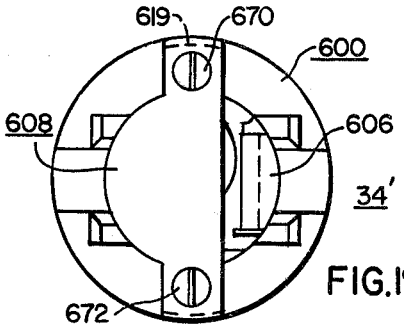
FIG.19.

PUSHBUTTON ASSEMBLY

BACKGROUND OF THE INVENTION

1. Field of the Invention

The invention relates in general to pushbuttons, and more specifically to pushbuttons having a key operable actuating plunger.

2. Description of the Prior Art

It is often necessary to limit access to a predetermined floor, or floors, of a building, such as an office building, to authorized personnel. For example, a floor housing a major computer system would be barred to the general public, but employees of this floor would be given some means to gain access. A convenient arrangement for providing restricted access to predetermined floors of a building is to employ key operated pushbuttons in the car call station of the elevator car, or cars, capable of serving the restricted floor, or floors.

A key operated pushbutton is generally a specifically constructed pushbutton, which is substituted as a complete assembly for the normal car call pushbutton. Copending application Ser. No. 941,617, filed Sept. 12, 1978, in the name of F. E. Coyle, entitled "Pushbutton Assembly", which is assigned to the same assignee as the present application discloses a new and improved pushbutton assembly which has many advantages for use as an elevator call pushbutton. The disclosed pushbutton is strong mechanically, and it will take misuse and abuse without damage to the electrical and mechanical components thereof. The housing includes an actuating plunger and legend blocks which identify a building floor. The cover carries all other components, including an electrical contact assembly and illuminating means. Assembly of the cover with the housing automatically operatively couples the actuating plunger with the electrical contact assembly, and it automatically aligns the illuminating means with the legend blocks. It would be desirable to add a key operable pushbutton option to the pushbutton assemblies constructed according to this concept.

SUMMARY OF THE INVENTION

Briefly, the present invention is a new and improved key operable pushbutton assembly which is compatible with the pushbutton assembly concept of the hereinbefore mentioned copending application. The keyed plunger of the invention may be directly substituted for the actuating plunger of the copending application, either at the time of manufacture of the pushbutton assembly, or in the field. The actuating plunger utilizes a key operated security lock having a locking tab which, in one key position, is within the cylindrical configuration of the plunger, permitting operation of the plunger to place a call. In another position, it extends outwardly from the actuating plunger, into a space between a stop member which couples the actuating plunger to the pushbutton housing, and a wall surface of a slot formed in the housing for receiving the stop member. This space normally provides the operating clearance required to advance the actuating plunger from its unactuated position to its actuated position. The locking tab thus selectively enters this space, in response to the position of a key, to either enable or disable the call button. The lock cylinder may be selected such that the key can only be removed when the button is disabled, to keep the associated floor under permanent security, or it may be selected such that the key may be removed in either the locked or the unlocked position, to selectively place the associated floor under security, when permanent security is not necessary or desired.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 9 is a plan view of a stop member shown in FIG. 2;

FIG. 10 is an edge view of the stop member shown in FIG. 9;

FIG. 11 is an elevational view of a locking tab shown in FIG. 2;

FIG. 12 is a plan view of the locking tab shown in FIG. 11;

FIG. 13 is an elevational view of a retainer member shown in FIG. 2;

FIG. 14 is a plan view of the retainer member shown in FIG. 13;

FIG. 15 is an end view of a lock cylinder shown in FIG. 2;

FIG. 16 illustrates a step in the assembly of the plunger shown in FIG. 2, in which the locking tab of FIGS. 11 and 12 is positioned on the end of the lock cylinder shown in FIG. 15;

FIG. 17 illustrates another step in the assembly of the plunger shown in FIG. 2, with the assembly of FIG. 16 being coupled with the plunger of FIGS. 4, 5, 6, 7 and 8, with the locking tab being illustrated in the unlocked position;

FIG. 19 illustrates the final step in the assembly of the plunger shown in FIG. 2, with a retainer plate member securely fastening the security lock within the plunger.

DESCRIPTION OF PREFERRED EMBODIMENTS

Figure 1:
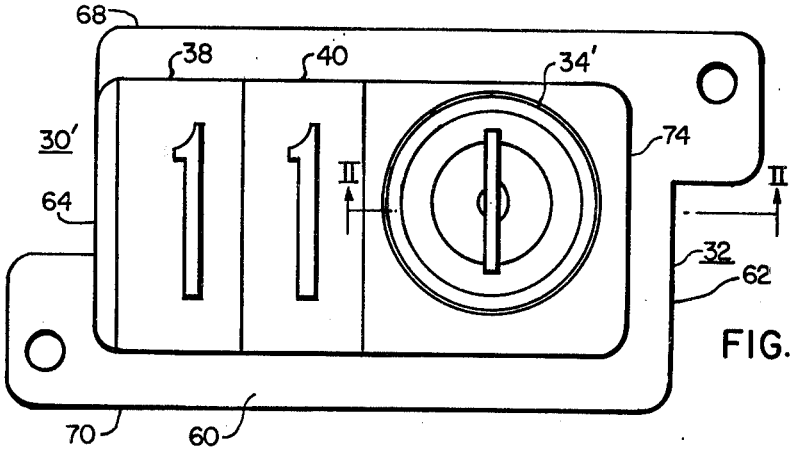
FIG. 1 is an elevational view of a pushbutton assembly which may be constructed according to the teachings of the invention.

Referring now to the drawings, and to FIG. 1 in particular, there is shown a pushbutton assembly 30' which may be constructed according to the teachings of the invention. As hereinbefore stated, it is desirable for the pushbutton of the present invention to incorporate the inventive concepts of copending application Ser. No. 941,617 and accordingly this application is hereby incorporated by reference. Components of pushbutton assembly 30' which may be the same as those in the incorporated application are identified with like reference numerals. A prime mark indicates modified components.

Figure 2:
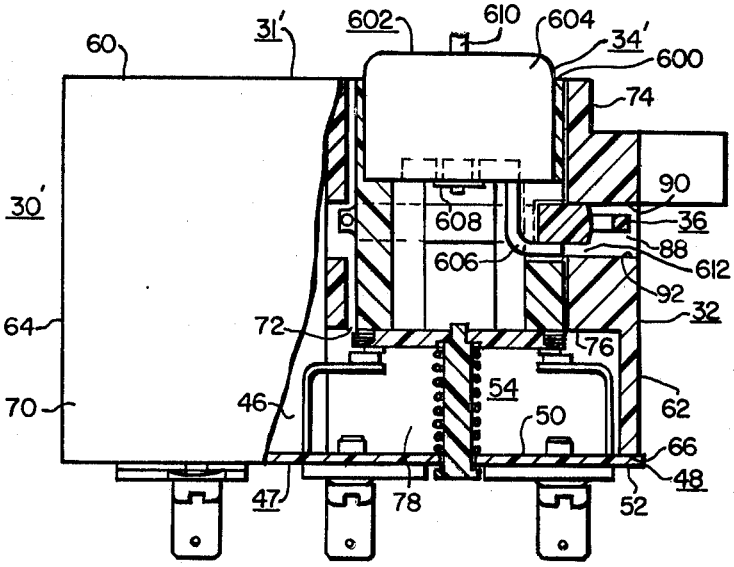
FIG. 2 is a view of the pushbutton assembly shown in FIG. 1, shown partially in section, with the section taken between and in the direction of arrows II—II, illustrating a pushbutton constructed according to the teachings of the invention, with the key operable plunger shown in the unlocked position.

Pushbutton assembly 30' shown in FIG. 1 is shown partially in section in FIG. 2, with the section being taken between and in the direction of arrows II—II in FIG. 1. Pushbutton assembly 30' includes a housing subassembly 31', and a cover subassembly 47.

The housing subassembly 31' includes a housing 32, an actuating plunger 34' carried by the housing 32 by virtue of a stop member 36, and legend blocks 38 and 40 fixed to the housing 32.

The cover subassembly 47, which may be identical to that of the incorporated application, comprises a printed circuit board 48 fixed to the housing 32.

The cover subassembly 47, which may be identical to that of the incorporated application, comprises a printed circuit board 48 fixed to the housing 32. Printed circuit board 48 includes first and second major opposed surfaces or sides 50 and 52, respectively. An electrical contact assembly 54 and illuminating means (not shown) are mounted on side 50 of the printed circuit board 48. The electrical contact assembly 54 is placed on printed circuit board 48 such that assembly of the cover subassembly 47 with the housing subassembly 31' automatically orients and operatively couples the actuating plunger 34' with the electrical contact assembly 54. The assembly of the cover subassembly 47 also automatically orients the illuminating means with the legend blocks 38 and 40.

Returning to the housing subassembly 31, housing 32 includes a front portion 60, side portions 62 and 64, respectively, a rear portion 66, and top and bottom portions 68 and 70, respectively. Housing 32 defines a major cavity 46 which includes a cylindrical recess 72. Recess 72 extends from the front portion 66, with a projection 74 on the front portion 66 surrounding the end of recess 72 which is accessible from the front portion. The other end of recess 72 terminates within cavity 46 at a predetermined wall portion 76 which is spaced from the rear portion 66. This spacing forms a subcavity 78 for receiving electrical contact assembly 54. The cylindrical recess 72 receives the actuating plunger 34'.

Side portion 62 includes a slot or opening 88 which intersects recess 72 intermediate its ends. Opening 88 receives stop member 36, with wall portions 90 and 92 which define sides of the opening 88 cooperating with the stop member 36 to provide the axial travel limits for the actuating plunger 34'. The electrical contact assembly 54 biases the actuating plunger 54' to its unactuated position wherein stop member 36 rests against wall portion 90. Actuation of the plunger 34' advances the stop member 36 against wall portion 92, with the electrical contact assembly 54 being operated by the actuating plunger 34' in this position. Release of the plunger 34' causes electrical contact assembly 54 to bias the plunger 34' back to its unactuated position. Thus, the operating distance of the pushbutton assembly 30 is the space between stop member 36 and wall portion 92 which defines one side of slot 88 in the housing 32.

Figure 3:
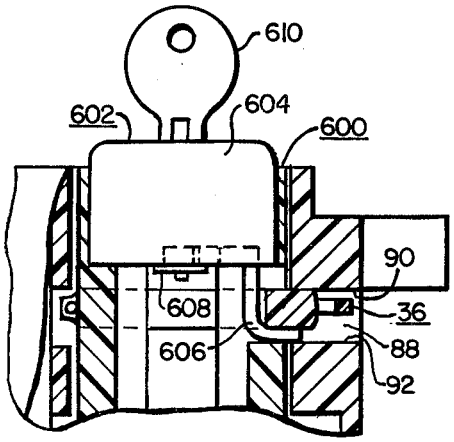
FIG. 3 is a fragmentary view of the pushbutton assembly shown in FIG. 2, illustrating the key operable plunger in the locked position.

The actuating plunger 34' includes a body portion 600, and a key operated security lock insert 602, with the insert 602 being shown in full. The security lock insert 602 includes a lock cylinder 604 having a locking tab 606, a retainer plate 608, and an operating key 610. FIG. 2 illustrates the security lock insert 602 with locking tab 606 in its unlocked position wherein the locking tab 606 is withdrawn within the cylindrical configuration of body portion 600. FIG. 3 illustrates the security lock insert 602 with locking tab 606 advanced to its locking position wherein the locking tab 606 extends into the space 612 between the stop member 36 and wall portion 92 of opening 88.

Figure 5:
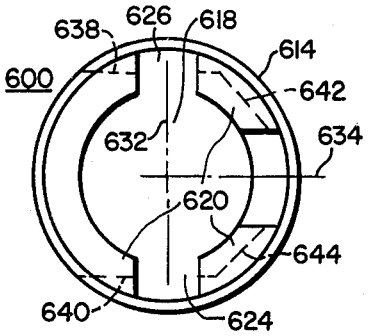
FIG. 5 is an end view of the plunger shown in FIG. 4, illustrating the end which receives a key operated security lock.
Figure 8:
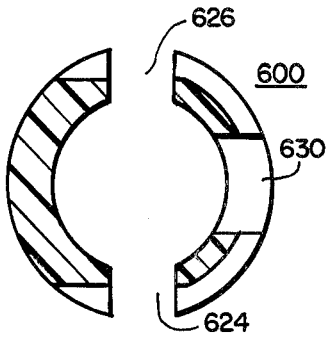
FIG. 8 is a cross-sectional view of the plunger shown in FIG. 4, taken between and in the direction of arrows VIII—VIII.
Figure 4:
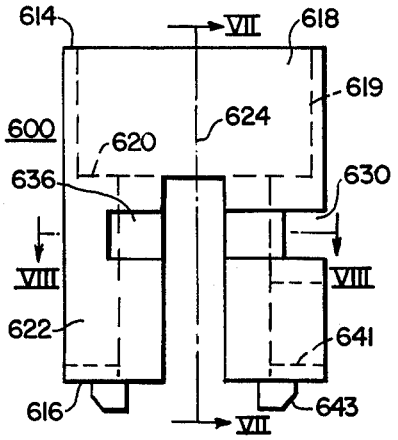
FIG. 4 is an elevational view of the plunger shown in FIG. 2.
Figure 7:
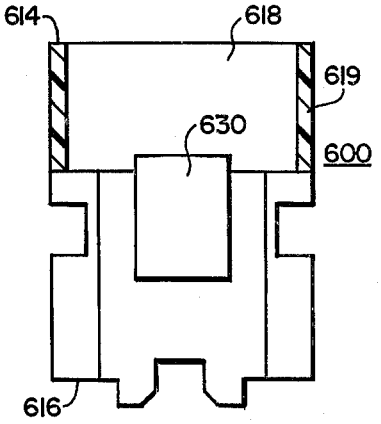
FIG. 7 is a cross-sectional view of the plunger shown in FIG. 4, taken between and in the direction of arrows VII—VII.
Figure 6:
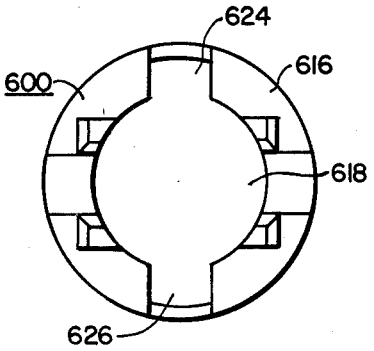
FIG. 6 is an end view of the plunger shown in FIG. 4, illustrating the end which cooperates with an electrical contact assembly within the pushbutton assembly.

FIGS. 4 through 8 illustrate body portion 600 of plunger 34' in detail, with FIGS. 4, 5 and 6 being elevational, top end and bottom end views, respectively. FIG. 7 is a cross-sectional view of plunger 34' taken between and in the direction of arrows VII—VII in FIG. 4. FIG. 8 is a cross-sectional view of plunger 34' taken between and in the direction of arrows VIII—VIII in FIG. 4. Body portion 600, which maybe formed of a high strength plastic, such as a polycarbonate, or any other suitable material, is generally cylindrical in configuration, having first and second ends 614 and 616, respectively. Body portion 600 is generally tubular, having an opening 618 which extends between its ends. Opening 618 is relatively large, starting at end 614, providing a relatively thin wall section 619. Opening 618 narrows sharply at a predetermined location intermediate ends 614 and 616, with the demarcation defining shoulders 620 for receiving and seating the lock cylinder 604 within the large portion of opening 618. The smaller diameter opening which starts at the shoulders 620 and extends to end 616 provides a relatively thick wall section 622.

Diametrically opposed, longitudinal extending slots 624 and 626 are formed in the thick wall section 622 with the slots 624 and 626 starting at shoulders 620 and extending completely to end 616. An opening 630 intermediate ends 614 and 616 is formed through the side wall of body member 600, with part of the opening being in wall section 619 and part of the opening being in wall section 622. Opening 630 is spaced equally between slots 624 and 626. In other words, with the center of slots 624 and 626 on a center line 632 in FIG. 5, the center line 634 of opening 630 would be perpendicular to center line 632. Opening 630 is sized to receive the locking tab 606.

A circumferentially extending groove 636 is formed in the thicker wall section 622 of body portion 600, intermediate ends 614 and 616, with groove 636 including parallel portions 638 and 640, which portions are also parallel with center line 634, and portions 642 and 644 which extend from portions 638 and 640, respectively, to opening 630. Groove 636 receives stop member 36.

End 616 includes a slot or groove 641 and a plurality of projections 643 for aligning and operatively coupling actuating member 34' with the electrical contact assembly 54, as described in detail in the incorporated application.

FIGS. 9 and 10 are plan and edge views, respectively, of stop member 36. Stop member 36 may be constructed as described in the incorporated application. Stop member 36 has a substantially U-shaped configuration, including first and second leg portions 190 and 192, respectively, and a connecting bight portion 194. Stop member 36 includes a substantially C-shaped central portion 195 which has a thickness dimension T selected to be a sliding fit with the width of the circumferential groove or slot 636 in body portion 600. The opening of the C-shaped configuration is sized to snugly engage the circumferential slot 636 in body portion 600.

FIGS. 11 and 12 are elevational and plan views, respectively, of locking tab 606 shown in FIG. 2. Locking tab 606 is substantially Z-shaped in the orientation shown in FIG. 11, having first and second spaced parallel leg portions 646 and 648, respectively, joined by an intermediate portion 650. The first leg portion includes an opening 652 configured to cooperate with an actuating pin of lock cylinder 604, such that rotation of the actuating pin through an arc of 90 degrees will move the second leg portion 648 between unlocked and locked positions. The second leg portion 648 is withdrawn within the cylindrical outline of body portion 600 in the unlocked position, and it extends outwardly beyond the outline of body portion 600 into space 612 shown in FIG. 2, in the locked position. If the width of slot 88 in W1 and the width of stop member 36 is W2, the thickness dimensions of the second leg portion 648 would be slightly less than W1 minus W2.

FIGS. 13 and 14 are edge and plan views, respectively, of retainer plate 608 shown in FIG. 2. Retainer plate 608 is an elongated member having first and second ends 652 and 654, a length dimension L substantially equal to the OD of body portion 600, and a width dimension W adjacent to its ends 652 and 654 selected to allow it to be positioned in body portion 600 via slots 624 and 626. Openings 652 and 654 are provided near the ends of the elongated retainer plate 608 for receiving screws which secure the various components of the security lock in assembled relation with the body portion 600. The width W of the retainer plate 608 may increase intermediate its ends, on the side opposite to the side which will be adjacent to the intermediate portion 650 of the locking tab 606, with this increase in width being indicated as rounded portion 660. This increased width provides a retainer surface for the first leg portion 646 of the locking tab 606.

FIG. 15 is an end view of lock cylinder 604 shown in FIG. 2, with the end shown being the end which is opposite to the key end. Lock cylinder 604 includes a cylindrical barrel member 662 having an end surface 664. End surface 664 has threaded openings 666 and 668 which receive screws which first extend through openings 656 and 658, respectively, in the retainer plate 608, such as screws 670 and 672 shown in FIG. 19. End surface 664 has a depression 674 formed therein for receiving the first leg portion 646 of locking tab 606.

Lock cylinder 604, which may be purchased from a lock company, such as the Illionis Lock Company of Wheeling, Illinois, has an opening which extends between its ends in which a cylindrical plug 676 is fixed. Cylindrical plug 676 includes key actuated tumblers which enable the cylindrical plug 676 to be rotated when they are retracted by insertion of key 610. One end of the cylindrical plug 676 has an opening in which key 610 is inserted, and the other end includes an actuating pin 678 configured to cooperate with opening 652 in the first leg portion 646 of locking tab 606.

In the assembly of the actuating plunger 34', the locking tab 606 is assembled with lock cylinder 604, as illustrated in FIG. 16, with the first leg portion 646 being disposed in the depression 674, and the actuating pin 678 disposed within opening 652 of leg portion 646.

Figure 18:
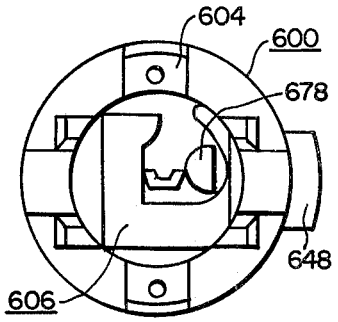
FIG. 18 is a view similar to that of FIG. 17, except with the locking tab advanced to its locked position.

FIG. 17 illustrates the next step of the assembly method, with the assembly of FIG. 16 being inserted into opening 618 of body member 600, from end 614, with threaded openings 666 and 668 being centered in slots 626 and 624, respectively, and with the second leg portion 648 and intermediate portion 650 being in opening 630 of body member 600. FIG. 17 illustrates actuating pin 678 and locking tab 606 in the unlocked position. FIG. 18 is a view which is similar to that of FIG. 17, except with the actuating pin 678 and the locking tab 606 in the locked position. It will be noted that in FIG. 17, leg portion 648 of the locking tab is within the cylindrical configuration of the body member 600, while in FIG. 18 it extends outside the cylindrical configuration. Thus, rotation of cylindrical plug 676 causes rectilinear movement of locking tab 606.

FIG. 19 illustrates the placement of the retainer plate 608, which is advanced into assembled position from end 616 of body member 600, and is secured to end 664 of the barrel member 662 via screws 670 and 672. The ends of the retainer plate 608 extend over the thin wall section 619 of body member 600, to hold the components in assembled relation. The resulting actuating plunger 34' is a direct replacement for the actuating plunger of the incorporated application.

The lock cylinder may be selected such that the key can only be removed when the button is disabled, in order to keep the associated floor under permanent security. Alternatively, the lock cylinder may be selected such that the key may be removed in either the locked, or the unlocked, position to selectively place the associated floor under security, when permanent security is not necessary or desired.

We claim as our invention:

1. A pushbutton assembly, comprising:

a housing defining a recess, and a slot which intersects said recess, said slot being formed by first and second wall portions of said housing, which are spaced by a dimension W1, an actuating plunger in said recess, an electrical contact assembly in said housing operably coupled with said actuating plunger, a stop member in said slot having a width dimension less than W1, said stop member cooperating with said actuating plunger and said first and second wall portions to limit the axial movement of said actuating plunger between an unactuated position wherein the stop member contacts said first wall portion, to provide a space between the stop member and the second wall portion, and an actuated position wherein the stop member contacts said second wall portion, and a key operated security lock in said actuating plunger having a locking tab movable between a locked position wherein the tab extends into the space between the stop member and second wall portion, to prevent actuation of said actuating plunger to its actuated position, and an unlocked position wherein the tab is withdrawn from said space.

2. The pushbutton assembly of claim 1 wherein the stop member is substantially U-shaped, having spaced leg portions, and the actuating plunger includes grooves for snugly receiving the spaced leg portions such that axial movement of the actuating plunger causes movement of the stop member.

3. The pushbutton assembly of claim 1 wherein the width of the stop member is W2, with the locking tab having a thickness dimension of substantially W1 minus W2.

4. The pushbutton assembly of claim 1 wherein the key operated security lock includes a barrel member, a cylindrical plug member in said barrel member having key actuated tumblers, an actuating pin fixed to the end of said plug member, with the locking tab being configured to be operated by said actuating pin, and a retainer member fixed to the end of said barrel member which secures the locking tab in position relative to the actuating pin, and the key operated security lock in the actuating plunger.

5. The pushbutton assembly of claim 4 wherein the locking tab is a substantially Z-shaped member having first and second spaced parallel leg portions joined by a connecting member, with the first leg portion functioning as a tab insertable between the stop member and second wall portion, and the second leg portion configured to be operated by the actuating pin.

6. The pushbutton assembly of claim 4 wherein the locking tab and actuating pin are configured such that rotary movement of the cylindrical plug member causes rectilinear movement of the locking tab.

7. A pushbutton assembly, comprising:

a housing having a recess, and a slot which intersects the recess which includes spaced wall portions, an actuating plunger in the recess, a stop member in the slot which secures the actuating plunger in the housing, and a key operated security lock in the actuating plunger which includes a locking tab insertable between said stop member and a wall portion of the slot, to prevent operation of said actuating plunger.

* * * * *